US006042424A

United States Patent [19]

LaCoy et al.

[11] Patent Number: 6,042,424

[45] Date of Patent: Mar. 28, 2000

[54] MULTI-CONTACT CONNECTOR FOR SCREENED CABLES

[75] Inventors: Donald Richard LaCoy, Boylston, Mass.; Brian Shepherd, Wendover, United Kingdom

[73] Assignee: Smiths Industries Public Limited Company, London, United Kingdom

[21] Appl. No.: 09/160,302

[22] Filed: Sep. 25, 1998

[30] Foreign Application Priority Data

Oct. 16, 1997 [GB] United Kingdom ..... 9721838

[51] Int. Cl.[7] ..... H01R 13/648

[52] U.S. Cl. ..... 439/608; 439/579

[58] Field of Search ..... 439/610, 95, 98, 439/101, 608, 579

[56] References Cited

U.S. PATENT DOCUMENTS

| | | | |
|---|---|---|---|
| 4,457,574 | 7/1984 | Walters | 439/610 |
| 4,519,665 | 5/1985 | Althouse et al. | 439/608 |
| 4,606,598 | 8/1986 | Drzymkowski et al. | 439/608 |
| 4,820,201 | 4/1989 | Van Brunt et al. | 439/610 |
| 4,984,992 | 1/1991 | Beamenderfer et al. | 439/108 |
| 5,125,854 | 6/1992 | Bassler et al. | 439/607 |
| 5,192,216 | 3/1993 | Knauber et al. | 439/579 |
| 5,222,898 | 6/1993 | Fedder et al. | 439/101 |
| 5,632,634 | 5/1997 | Soes | 439/101 |

FOREIGN PATENT DOCUMENTS

| | | |
|---|---|---|
| 0 295 154 | 12/1988 | European Pat. Off. . |
| 2120467 | 11/1983 | United Kingdom . |
| WO 93/12564 | 6/1993 | WIPO . |

*Primary Examiner*—Lincoln Donovan
*Assistant Examiner*—Hae Moon Hyeon
*Attorney, Agent, or Firm*—Pollock, Vande Sande & Amernick

[57] ABSTRACT

An electrical connector for several screened cables has a transverse metal ground plate formed with rectangular apertures, one for each cable. The conductors in each cable are secured at their ends in contacts and these are supported in rectangular insulating beads. The screen of each cable extends over the bead and is trapped in position within a metal cage secured to the outside of the bead. The cage is a resilient push fit in a respective one of the apertures so that the screens are connected via the cage to the ground plate.

7 Claims, 1 Drawing Sheet

MULTI-CONTACT CONNECTOR FOR SCREENED CABLES

BACKGROUND OF THE INVENTION

This invention relates to electrical connection.

The invention is more particularly concerned with electrical connection to the screening sheath of an electrical cable, such as where the cable is connected to an electrical connector.

In electrical connectors having many contacts, it can be very difficult to provide effective termination of the screening sheaths on the individual cables to the connector ground body, because of the limited space. Another problem is in providing a connector that can be serviced easily, enabling ready access to the individual cables so that these can be repaired or modified.

SUMMARY OF THE INVENTION

It is an object of the present invention to provide an improved electrical connection of a screening sheath.

According to one aspect of the present invention there is provided an electrical connector including a plurality of contact members, a plurality of screened electrical cables each having at least one conductor making electrical contact with a respective one of the contact members, and a ground plate electrically connected with the screens of the cables and insulated from the conductors, the ground plate being an electrically-conductive plate having a plurality of apertures therein, one for each cable, each cable having a cage member extending around the cable and making electrical connection with its respective screen, and each cage member being arranged to be a resilient push fit in a respective one of the apertures so as to make electrical connection with the ground plate.

The cage member preferably extends externally along a part of the length of the contact members and each of the screens is preferably trapped between a respective electrically-insulative member and the inside of a respective cage member. Each cage member may have at least one spring element arranged to make contact within a respective aperture. Each cable may include two conductors connected to respective ones of two contact members. The apertures in the plate and the cage members are preferably substantially rectangular in section.

According to another aspect of the invention there is provided an electrical connector including a plurality of contact members, a plurality of screened electrical cables each having a screen and at least one conductor connected at an end with a respective one of the contact members, an electrically-conductive plate extending transversely of the connector and having a plurality of apertures therein, one for each cable, a plurality of electrically-insulative members extending around a part at least of the length of the contact members, and a cage member extending around each electrically-insulative member, the screen of each cable being trapped between the electrically-insulative member and the cage, and each cage member being a resilient push fit in a respective one of the apertures such that the cage members electrically connects the screens with the plate and the electrically-insulative member insulates the contacts from the plate.

Each cable preferably includes two conductors, the apertures and the cage members being generally rectangular and each electrically-insulative member supporting two contact members extending side-by-side and connected to respective ones of the conductors.

An electrical connector according to the present invention, will now be described, by way of example, with reference to the accompanying drawing.

DETAILED DESCRIPTION OF THE PREFERRED EMBODIMENT

Figure 1:
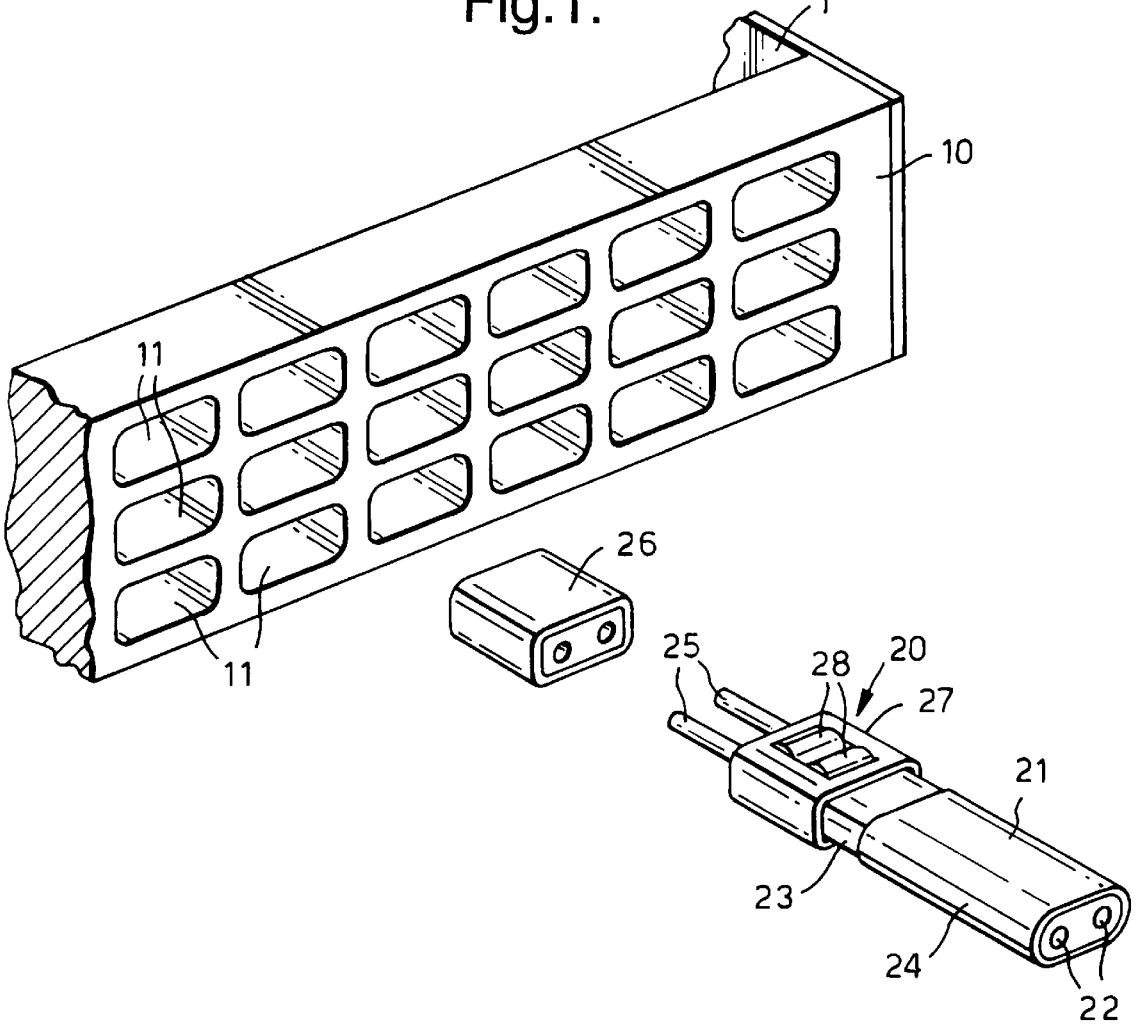
FIG. 1 is an exploded perspective view from the rear of a part of the connector.
Figure 2:
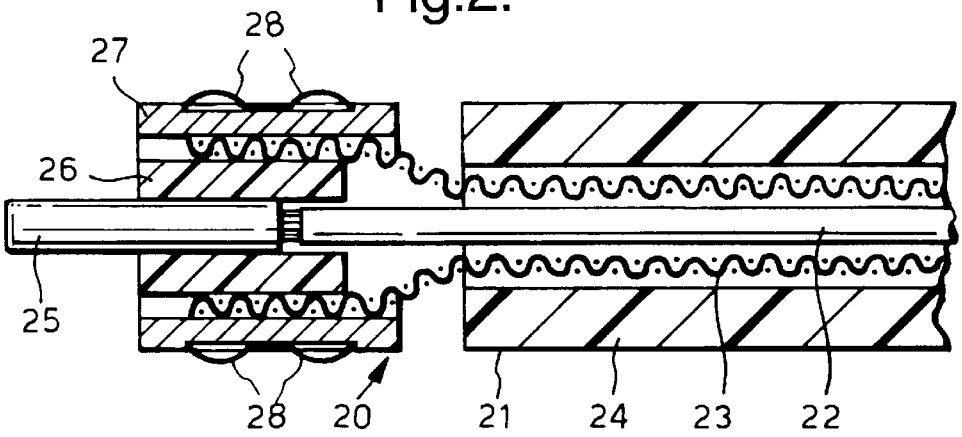
FIG. 2 is a cross-sectional side elevation view of a cable forming a part of the connector.

The connector has a metal outer shell 1 with a ground plate 10 in the form of a thick, rigid metal plate extending transversely across the full width and height of the shell. The ground plate 10 is electrically connected with the shell 1 around its outer edge and may be an integral single piece with the shell. The ground plate 10 has an orthogonal array of apertures 11 of rectangular shape with rounded corners.

The connector is completed by a number of cable assemblies 20 (only one of which is shown), one for each of the apertures 11. Each cable assembly 20 includes a cable 21 having two insulated conductors 22 extending within a braided screening sleeve 23, which is, in turn, protected within an outer insulative jacket 24. The forward end of each conductor 22 is secured into the rear of a respective contact pin or socket 25, such as by soldering or crimping. The two contacts 25 extend parallel to one another side-by-side and are supported by an electrically-insulative bead 26 of rectangular shape slipped over the two contacts. The contacts 25 may be contained fully within the insulator 26 or project from its forward end. The screening sleeve 23 extends along the outside of the bead 26 and is trapped in position by means of an outer metal cage 27 fastened securely about the bead 26. The external shape of the cage 27 corresponds to the shape of the apertures 11 in the ground plate 10, the upper and lower surfaces of the cage being formed with spring contact elements 28. The cage 27 extends externally along the rear part of the contact elements 25 and is electrically insulated from the two contacts and the conductors 22, by the bead 26, but is electrically connected with the screening sleeve 23. The cage 27 makes a close sliding fit within a respective one of the apertures 11 in the ground plate 10, producing a gas-tight interface with the inside surface of the aperture and making electrical contact with the aperture around its entire circumference. When the cage 27 of each cable assembly 20 is fully inserted in its respective aperture 11, the contacts 25 mate with cooperating contacts (not shown) in a mating connector. A receptacle connector with sockets extending from the front of the insulator would mate with a similar plug connector having pins buried within its insulator.

This arrangement achieves an effective, low impedance connection to the screening sleeves of each cable assembly close to its forward end. The arrangement also permits ready removal and replacement or repair of individual conductors, because each pair of contacts and their screens can be removed without disturbing any other screened cables.

What we claim is:

1. An electrical connector comprising: a plurality of contact members; a plurality of screened electrical cables each having a screen and at least one conductor making electrical contact with a respective one of said contact members; an electrically-insulative member for each cable supporting a respective one of said contact members, said screen of each cable extending externally along said electrically-insulative member; a ground plate electrically connected with said screens of said cables and insulated from said conductors, said ground plate being a plate of electrically-conductive material having a plurality of apertures therein, one for each said cable; and a cage member extending around each said electrically-insulative member, trapping the respective screen between the electrically-insulative member and the cage so as to make electrical connection with said screen, and wherein each said cage member is arranged to be a resilient push fit in a respective one of said apertures so as to make electrical connection with said ground plate.

2. An electrical connector according to claim 1, wherein each said cage member has at least one spring contact element arranged to make contact within a respective one of said apertures.

3. An electrical connector according to claim 1, wherein each said cable includes two conductors and two contact members, respective ones of said conductors being connected to respective ones of said contact members.

4. An electrical connector according to claim 1, wherein the said apertures in said plate and said cage members are substantially rectangular in section.

5. An electrical connector comprising: a plurality of contact members; a plurality of screened electrical cables each having a screen and at least one conductor connected at an end with a respective one of said contact members; an electrically-conductive plate extending transversely of said connector, said plate having a plurality of apertures therein, one for each said cable; a plurality of electrically-insulative members extending around at least a part of the length of said contact members; and a cage member extending around each said electrically-insulative member, wherein the screen of each said cable is trapped between said electrically-insulative member and said cage, and wherein each said cage member is a resilient push fit in a respective one of said apertures such that said cage member electrically connects said screens with said plate and said electrically-insulative member insulates said contacts from said plate.

6. An electrical connector according to claim 5, wherein each said cable includes two said conductors, wherein said apertures and said cage members are generally rectangular, and wherein each said electrically-insulative member supports two said contact members extending side-by-side and connected to respective ones of said conductors.

7. An electrical connector comprising: a plurality of contact members; a plurality of screened electrical cables each having a screen and at least one conductor making electrical contact with a respective one of said contact members; a ground plate electrically connected with said screens of said cables and insulated from said conductors, said ground plate being a plate of electrically-conductive material having a plurality of apertures therein, one for each said cable; and a cage member extending around each said cable and making electrical connection with its respective screen; wherein each said cage member is arranged to be a resilient push fit in a respective plate; and includes at least one spring contact element arranged to make contact within a respective one of said apertures so as to make electrical connection with said ground plate.

* * * * *